US005127356A

United States Patent [19]

Schenkenberger

[11] Patent Number: 5,127,356

[45] Date of Patent: Jul. 7, 1992

[54] BOAT CARRYING DEVICE

[76] Inventor: Milton Schenkenberger, 7136 S. 49th St., Franklin, Wis. 53132

[21] Appl. No.: 604,104

[22] Filed: Oct. 29, 1990

[51] Int. Cl.[5] ..... B63B 17/00

[52] U.S. Cl. ..... 114/347; 294/15; 224/266; 224/272

[58] Field of Search ..... 114/343, 347, 90; 294/15, 16, 17; 224/191, 242, 210, 250, 266, 267, 270, 271, 272

[56] References Cited

U.S. PATENT DOCUMENTS

| | | | |
|---|---|---|---|
| 611,829 | 10/1898 | Brown | 114/347 X |
| 1,721,745 | 7/1929 | Otto | 294/15 |
| 2,353,662 | 7/1944 | Goldman | 114/90 X |
| 2,552,205 | 5/1951 | Moss | 224/272 |
| 2,968,511 | 1/1961 | Noblette | 294/15 X |
| 3,377,095 | 4/1968 | Allen | 294/15 |
| 3,436,778 | 4/1969 | Stevens et al. | 294/15 |
| 3,661,308 | 5/1972 | Walters | 224/270 |
| 4,236,267 | 12/1980 | Lewis et al. | 114/347 |
| 4,423,898 | 1/1984 | Spor | 294/15 |
| 4,641,874 | 2/1987 | Grenzer | 294/15 |
| 4,804,123 | 2/1989 | French | 224/266 |

FOREIGN PATENT DOCUMENTS

| | | | |
|---|---|---|---|
| 169222 | 10/1951 | Australia | 294/15 |
| 2499932 | 8/1982 | France | 114/90 |

*Primary Examiner*—Jesus D. Sotelo
*Assistant Examiner*—Stephen P. Avila
*Attorney, Agent, or Firm*—Willis B. Swartwout, III

[57] ABSTRACT

The invention consists of a water craft portaging device which includes a pair of graft engaging yokes adapted to engage the bow and stern of a craft in the upright position and be coupled thereto, a first elongated belt adapted to receive one axial extremity of elongated poles adapted to be axially slidably received through spaced parallel tubular sleeves on the yokes. A second sectional adjustable belt adapted to be worn around the neck and shoulders of a person for portaging, the extremities being both adjustable and attachable by looping to the other axial extremity of the elongated poles. The second belt being further adaptable to being worn across the small of the back of a seated person with the loops adjusted to receive the angular leg portion formed by the shin, knee and thigh of the seated person forming a back support and rest.

4 Claims, 3 Drawing Sheets

BOAT CARRYING DEVICE

BACKGROUND OF THE INVENTION

The field of the present invention is an improved boat carrying device including a sling which is also usable as a back support.

Fishing in Canada, the "boundary waters" and other remote locations has grown much in popularity in recent years. Often, due to limitations as to weight and the things you can carry in to remote locations, it is needed to have a very light canoe. An aluminum or similar light canoe is still an excellent container for the rest of the gear of the users in portaging if the canoe can be maintained in its upright position instead of upside down as is usual in portaging. In the wilderness it is easier to carry the craft in a stretcher-like fashion rather than inverted over the head.

At the same time because of the restrictions as to weight and bulk of carry-in items it is desirable to have gear that is capable of performing one or more tasks.

SUMMARY OF THE INVENTION

The present invention is to provide a pair of yokes to engage one with the bow and the other with the stern of a lightweight water-craft. A pair of handles is provided for engaging with each yoke and one of a pair of slings is provided for a human wearer which can engage with the handles when worn around the neck and shoulders of the user and which can act as a back support when sitting in the craft to paddle or propel the craft.

It is an object of the present invention to provide a combination of a fore and aft carrying yoke that are mountable on the bow and stern of a water craft and adapted to receive detachable carrying handles.

It is a further object of the present invention to provide in combination with the yokes above described a pair of slings one adapted to fit around the neck and shoulders of a human user and having descending strap portions formable into a loop to engage with the detachable carrying handles.

It is a further object of the present invention to provide in a combination as above described a first set of adjustment means on said sling to adapt the sling to the relative height of the human user.

It is still a further object of the present invention to provide in a combination as above described a said sling formed from wide webb material and providing said adjustment means for adapting the sling straps to selectively form loops which can encircle the bent knees of the wearer when sitting in a watercraft to paddle, or encircle the yoke handles for carrying.

The foregoing and other objects and advantages of the invention will appear from the following description. In the description, reference is made to the accompanying drawings which form a part hereof and in which there is shown by way of illustration a preferred embodiment of that invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
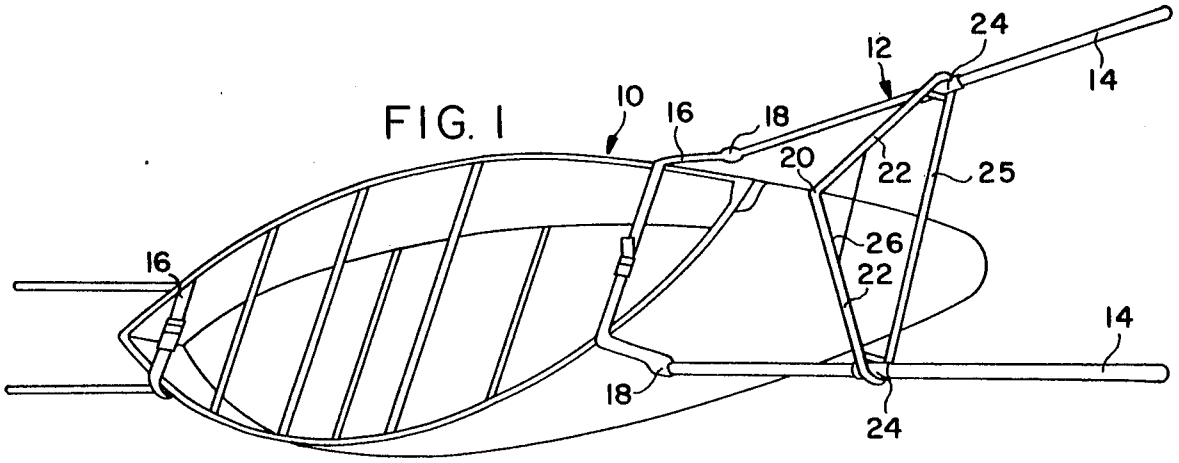
FIG. 1 is a view in perspective of yokes forming a part of the combination of the present invention attached to a canoe.
Figure 2:
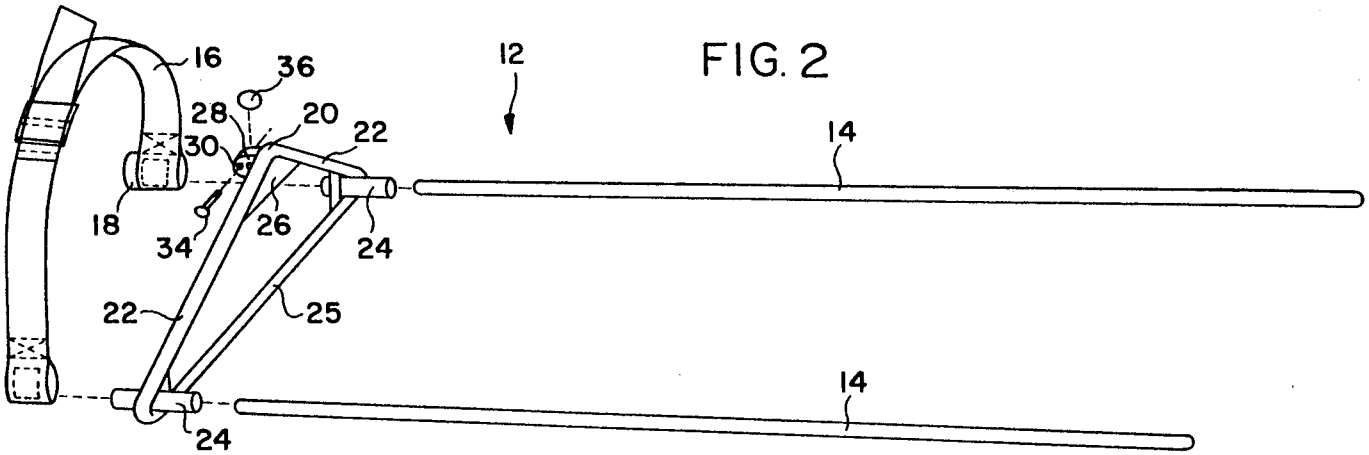
FIG. 2 is an exploded view of one of the yokes and slings forming a part of the combination of the present invention.
Figure 3:
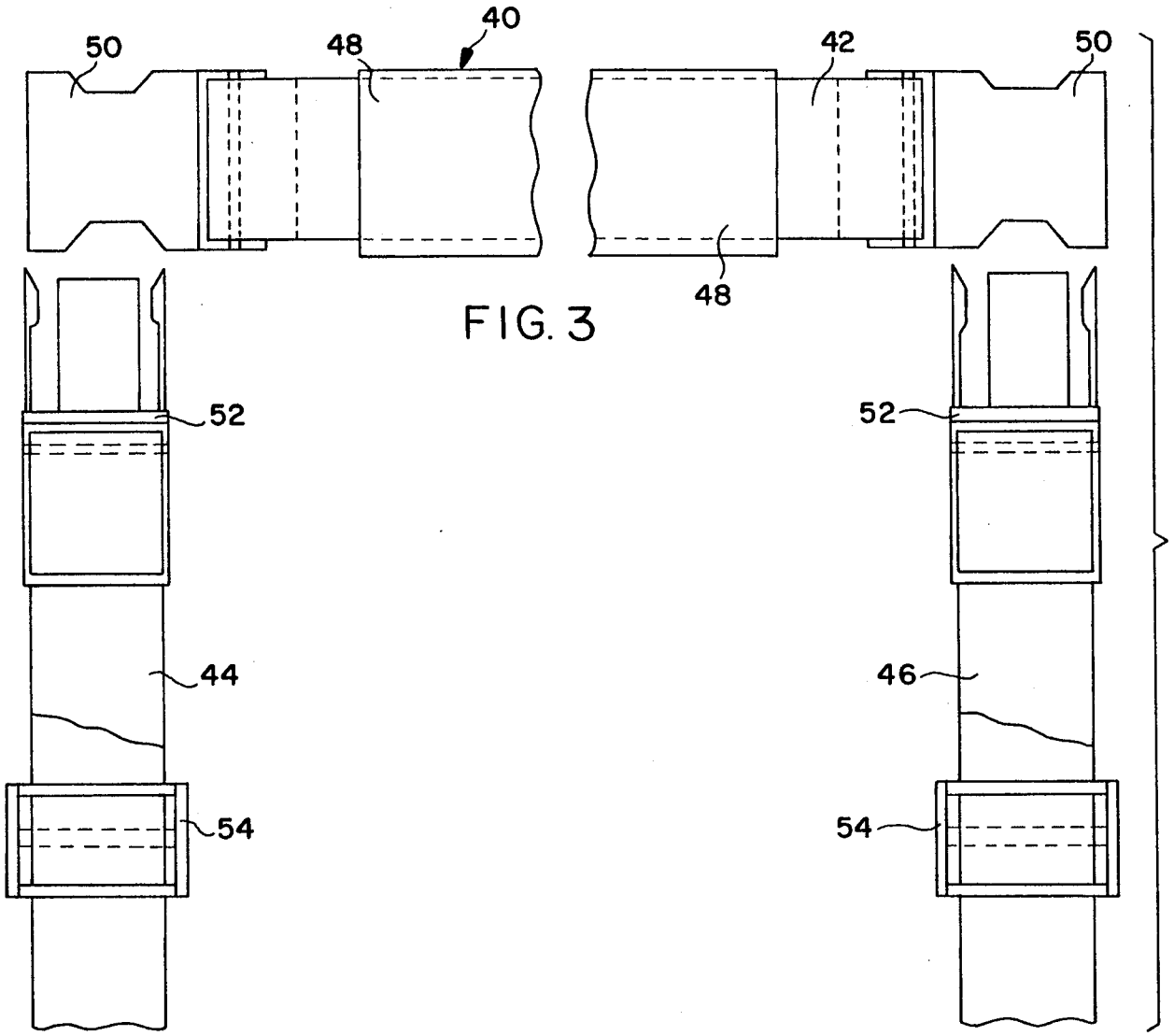
FIG. 3 is a segmentd view of a sling forming a part of the combination of the present invention for portaging or transporting.
Figure 4:
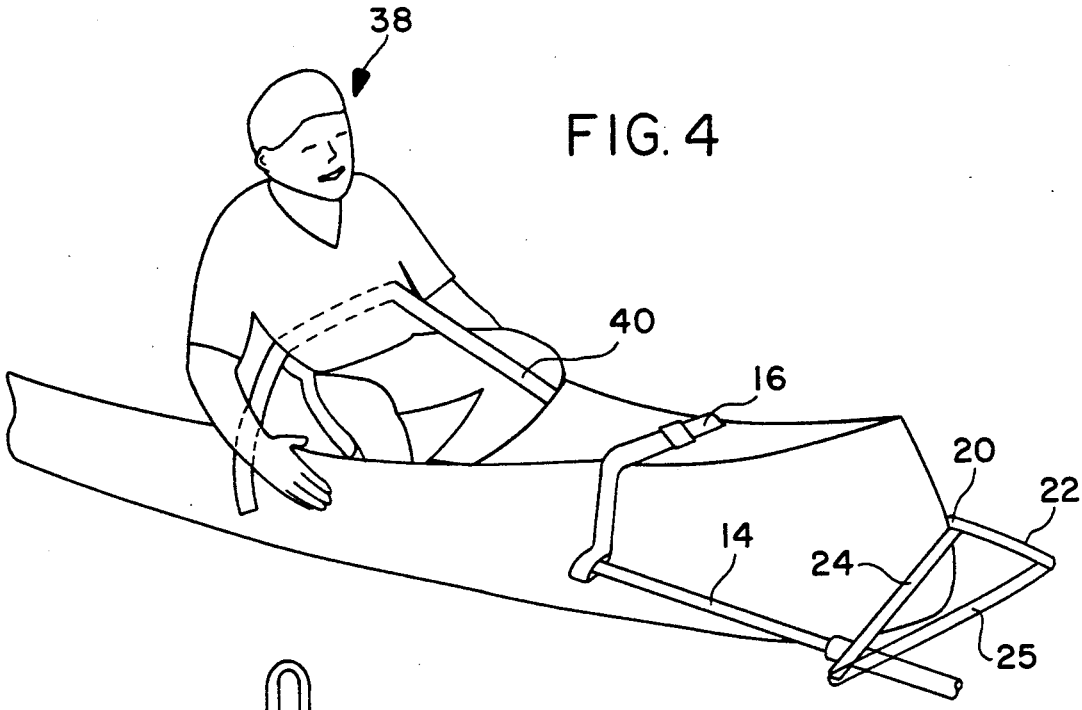
FIG. 4 shows the sling forming a part of the present invention worn by a user for support when paddling a canoe.

Referring now to the drawings and more particularly to FIG. 1 a canoe is shown and is generally identified by the numeral 10. Attached to canoe 10 is a yoke generally identified by the numeral 12. In most cases the bow and stern of a canoe 10 is shaped similarly or the same, and for ease in making this disclosure only one yoke 12 is being shown in its entirety but it should be understood that two yokes 12 would be used in the transporting or portaging of a canoe 10 or other craft light in weight.

Each yoke 12 is made from light weight metal or wood parts and includes a pair of handles 14. These handles 14 may be made from any suitable material but are customarily wood poles. Yoke 12 is further provided with an elongated first sling or belt 16 which will be adjusted from from one pole or handle 14, to the other pole or handle 14 over the gunwales of the canoe 10 when yoke 12 is in position on the canoe 10 as hereinafter described. Belt 16 may be made from webbed material or other woven material and may be adapted to fasten around the tubular member or pole 14 in any suitable fashion or it may be provided with cup-type sockets 18 slightly larger in cross-sectional dimension and shape than the handles or poles 14 to receive handles or poles 14.

Yoke 12 is generally triangular in vertical plan view and in its normal position in use the apex 20 of yoke 12 points upwardly.

Figure 6:
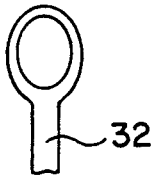
FIG. 6 is a plan view of a bow or stern eye bolt.

Yoke 12 has a pair of legs 22 which extend downwardly from apex 20 and which diverge relative to each other as they travel downwardly from apex 20. At the ends of legs 22 remote from apex 20 are sleeves 24 generally tubular in cross-section and geometrically shaped to receive slidably therethrough handles 14. The sleeves 24 are joined by a tubular base 25. On the legs 22 adjacent to apex 20 and touching apex 20 is a triangular plate 26 connected to the vertical planer side of yoke 12 which faces the craft 10 to be portaged. This plate 26 is for the attachment of a hanger bracket 28, generally U-shaped, by any suitable process such as bolting. Each leg of U-shaped bracket 28 is provided with an aperture 30 adjacent its extremity away from plate 26. Apertures 30 are aligned with an eyelet 32 on canoe 10 after which a pin 34 is passed through the apertures 30 and eyelet 32 and secured against accidental removal by a cotter-key 36. See FIG. 6 for a plan view of the eyelet 32.

It can now be seen that a person 38 may fasten cup-type sockets 18 as shown in FIG. 1 around one end each of two poles 14 or loop a belt 16 at each end and slide the loops over the ends of poles 14 inserted through sleeves 24. The person 38 could then pick up one end of canoe 10 simply by lifting as he or she is standing between the poles or handles 14.

Lifting as described puts much pressure on the arms of an individual person 38. Much more strength can be summoned to the task by allowing the back and legs of the person 38 to exert the lift. A second belt 40 is provided which includes a center section 42, a first end section 44 and a second end section 46. Center section 42 has a pad 48 which is adapted to pad the neck in one use and to act as a back support pad in another use both of which will be hereinafter explained.

Figure 5:
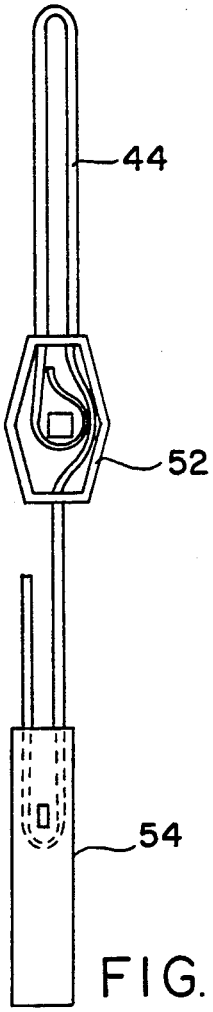
FIG. 5 is a detail view of the adjusting means, some portions in fragment to show details of construction.

Center section 42 is surrounded by centrally disposed pad 48 and at each end of section 42 there is a female clip member 50, adapted to receive a male clip member 52 in spring locking engagement. The male clip member 52 is located, one on each of the end sections 44 and 46 previously described at one end of the said sections 44 and 46. These clips 50 and 52 are well known in the webbed belting art and need not be further described here. The ends of sections 44 and 46 remote from male clip member 52 are formed into a loop as shown in FIG. 5 of the drawings. This is accomplished by adjusting bracket or means 54 to which the end of sections 44 and 46 remote from clip member 52 are attached and through which the remaining webbed belting of sections 44 or 46 as the case may be passes such that through the adjustment of the belting longitudinally along its axis a loop is formed by frictional engagement. If the center section 42 is joined to end sections 44 and 46 and the loops are formed as described above in end sections 44 and 46 it is a simple matter to place the pad 48 on the neck of a person 38 for cushioning purposes and to put the loops around poles or handles 14 and then to carry by using the strength of the back and legs instead of the arms. Note that in this style of belt 40 there is no absolute need to grip pole or handle 14 with the hands. A cupsocket 18 could be substituted for the loop in belt 40 if desired but would detract from the utility of the belt 40.

The reason for the last statement of the above paragraph is that in the belt structure 40 taught with the loops at the ends of sections 44 and 46 remote from male clip members 52 are usable for another beneficial purpose. In the typical canoe 10 there is no back support for the paddler. The paddler simply sits on a seat or thwart and paddles and his or her back tires quite rapidly. However by putting the pad 48 at the center of the small of the back on center section 42 and then adjusting the bracket 54 and the longitudinal passage therethrough of the belting material an extended loop may be created to put around the shin, bent knee and thigh portion of the leg of a person 38 thereby forming a padded support or rest for the paddler. This greatly extends the length of time a paddler may paddle before a rest is required.

I claim:

1. A portaging and back supporting device comprising in combination:

(a) a pair of yokes adapted to engage with a bow and stern of a watercraft and each provided with a pair of spaced, parallel tubular sleeves, each of said yokes generally triangular in vertical plan having a base and angularly disposed sides converging in an apex remote from said base, said yoke pointing upwardly and provided with a triangular plate on the watercraft facing side of said yoke apex, to which a U-shaped bracket having bracket legs and a closed end joining said legs, said legs having registering apertures adjacent the open end of said U-shaped bracket, said apertures adapted to further register with an eyelet on one end of said watercraft, the converging legs of said triangularly shaped yoke joined with said triangle base, the juncture of each leg with said triangle base being the location of a hollow tubular sleeve;

(b) a pair of elongated handle poles for each yoke adapted to slide through said sleeves and extend out of said sleeves in both axial directions relative to said poles and said sleeves;

(c) a first belt for each yoke adapted to engage one set of axial extremities of said poles and to be strapped over the watercraft gunwales to prevent tilting of said yoke vertically relative to said bow and stern respectively; and (d) an elongated second belt adapted to be worn around a neck and shoulders of a person and to be looped at ends of said second belt remote from the said neck and shoulders and to receive a second set of axial extremities of said poles;

whereby the watercraft may be portaged in its upright position by the strength of a person's legs, back and shoulders including all of the watercraft contents.

2. The structure as set forth in claim 1, wherein said handle poles are elongated and of the same geometrical cross-sectional shape as the cross-sectional shape of said sleeves except said poles are slightly smaller in cross-sectional area than said sleeves to slidably axially pass through said sleeves with a portion of the axial length of said poles extending in each axial direction beyond the said sleeves.

3. The structure as set forth in claim 1, wherein said first belt is made from a webbed material, is elongated having pole engaging extremities at the ends and is axially adjustable as to length, and wherein the extremities of said belt are provided with pole engaging structure.

4. The structure as set forth in claim 1, wherein said second belt is composed of an elongated central section and two elongated end sections all made from webbed material, said central section provided with a circumscribing central pad, and female end clip sections at each axial extremity, each of said end sections having a male clip section at one extremity adapted to spring engage with one of said female end clip sections and provided with an adjustment clip at the extremity remote from said male clip section, said adjustment clip adapting the end sections to be frictionally adjusted to form loops at the extremities remote from said male clip to receive an axial extremity of one of said poles, and adjustable to a larger loop such that the central section may be placed across the small of the back of a person who is seated and the loops receive shin, knee and thigh angle of the leg to provide a back rest for a paddler.

* * * * *